US009682895B1

(12) United States Patent
Patel et al.

(10) Patent No.: US 9,682,895 B1
(45) Date of Patent: Jun. 20, 2017

(54) BEAD MILLED SPRAY DRIED NANO-EXPLOSIVES

(71) Applicants: Rajen B. Patel, Parsippany, NJ (US); Victor Stepanov, Highland Park, NJ (US); Ashok Surapaneni, Hackettstown, NJ (US); Anthony DiStasio, New York, NY (US)

(72) Inventors: Rajen B. Patel, Parsippany, NJ (US); Victor Stepanov, Highland Park, NJ (US); Ashok Surapaneni, Hackettstown, NJ (US); Anthony DiStasio, New York, NY (US)

(73) Assignee: The United State of America as Represented by the Secretary of the Army, Washington, DC (US)

( * ) Notice: Subject to any disclaimer, the term of this patent is extended or adjusted under 35 U.S.C. 154(b) by 420 days.

(21) Appl. No.: 14/217,964

(22) Filed: Mar. 18, 2014

(51) Int. Cl.

| | |
|---|---|
| ***F42B 33/04*** | (2006.01) |
| ***C06B 21/00*** | (2006.01) |
| ***C06B 25/34*** | (2006.01) |

(52) U.S. Cl.
CPC ..... *C06B 21/0008* (2013.01); *C06B 21/0066* (2013.01); *C06B 25/34* (2013.01)

(58) Field of Classification Search
CPC . C06B 21/0008; C06B 25/34; C06B 21/0066; D03D 23/00; F42B 33/04
See application file for complete search history.

(56) References Cited

U.S. PATENT DOCUMENTS

| | | | | |
|---|---|---|---|---|
| 5,156,779 A * | 10/1992 | McGowan | ..... | B01F 5/0405 149/109.6 |
| 7,964,045 B1 * | 6/2011 | Stec, III | ..... | F42C 19/00 149/109.6 |
| 8,936,689 B1 | 1/2015 | Stepanov et al. | | |

OTHER PUBLICATIONS

NDIA "2007 Insensitive Munitions & Energetic Materials Technology Symposium", Miami, Florida, available from http://www.dtic.mil/ndia/2007im_em/2007im_em.html (last accessed Oct. 3, 2016). (Program Agenda).
Patel, Rajen et al, "Production and Coating of Nano-RDX Using Wet Milling," NDIA Insensitive Munitions and Energetic Materials Symposium, presentation slides dated Oct. 15, 2007. (Presentation Slides).
Patel, Rajen et al, Title Not Available, NDIA 2007 Insensitive Munitions & Energetic Materials Technology Symposium proceedings paper, 2008. (Proceedings paper).
Redner, P. et al, "Production and Characterization of Nano-RDX", 25th Army Science Conference, Nov. 27-30, 2006, Orlando, Fla.
"Ostwald Ripening", Wikipedia, https://en.wikipedia.org/wiki/Ostwald_ripening (last accessed Sep. 21, 2016).

* cited by examiner

*Primary Examiner* — Aileen B Felton
(74) *Attorney, Agent, or Firm* — Henry Goldfine; Lisa H. Wang

(57) ABSTRACT

An effective, safe and economical method of manufacture of an insensitive high explosive molding powder usable as a booster HE. The method preferably involving the steps of adding a binder and a crystalline high explosive to water, grinding that suspension in a bead mill until the crystalline high explosive is nano-sized, and precipitating the binder and crystalline high explosive using a spray dryer. Alternatively, an aqueous suspension of the crystalline high explosive can be ground in the bead mill and the binder subsequently added, prior to spray drying. A fatty alcohol, water defoaming/dispersant/surfactant agent can be added to the dissolved binder/suspended crystalline high explosive, to aid in the manufacturability.

8 Claims, No Drawings

BEAD MILLED SPRAY DRIED NANO-EXPLOSIVES

FEDERAL RESEARCH STATEMENT

The invention described herein may be manufactured, used, and licensed by or for the U.S. Government for U.S. Government purposes.

BACKGROUND OF INVENTION

Field of the Invention

The present invention relates to a method of manufacture for insensitive crystalline high explosive (HE) molding powders, and more particularly, to such a method wherein the crystalline HE within the molding powders are nanocrystalline and are uniformly coated with non-energetic, i.e. inert, binders.

Related Art

Explosive molding powders are known in the art and are used for various types of ordnances such as: grenades, land mines, missile warheads, and demolition explosives. Such explosive molding powders are extrudable or pressable into a desired shape for use in a given ordnance system. Common high explosive (HE) materials used in such explosive molding powders include HMX, RDX, and CL-20. Such an HE material is mixed with a binder, to bind the crystalline particles together, so that the resulting explosive powder can be physically molded to meet the particular application requirements. The primary usage of the binder beyond the "binding" functionality is to make the explosive material less sensitive to external stimuli.

Often, explosives applications involve balancing the desired insensitivity of the explosive with its performance—especially in applications involving boosters. Current booster explosives must have a sufficient energy output to reliably initiate newer, relatively insensitive main charge explosive fills—while the booster itself desirably has a lower level of sensitivity to unintended stimuli. Most existing booster HE formulations exhibit undesired levels of sensitivity; thereby, increasing the vulnerability of the entire munition to accidental initiation.

The crystal size of an HE can influence sensitivity to unintended stimuli, such as shock and impact; more specifically, it has been demonstrated that the sensitivity of a high explosive decreases with decreasing crystal size. See, Stepanov et al. "Production and Sensitivity Evaluation of Nanocrystalline RDX-based Explosive Compositions", Propellants, Explosives, Pyrotechnics, v. 36, 2011. Further, improved performance characteristics are also associated with crystal size reduction. For example, the detonation failure diameter, also referred to as the critical diameter, is known to decrease with decreasing crystal size. However, while Fluid Energy Milled (FEM) HMX is available with typically an average mean diameter of several microns, nanocrystalline HEs are currently not commercially available; and, prior to this disclosure, there was no known commercial method of production thereof. Further, the FEM HMX that is currently commercially available is not as insensitive as desired and does not provide the needed performance in small critical diameter applications.

U.S. Pat. No. 6,485,587, issued Nov. 26, 2002 to Han et al., incorporated herein by reference, discloses methods for the preparation of explosive molding powders typically consist of batch slurry coating of crystalline HE with a binder. In such processes, the explosive crystals are dispersed in aqueous slurry, to which a lacquer solution consisting of an organic solvent and the binder ingredients are added. However, dispersion of nano-crystals in aqueous slurry is not effective due to the high tendency of such very small crystals to agglomerate, resulting in poor binder coating about the crystals. Further, there is a tendency of nanocrystals to "ripen" (Ostwald ripening)—resulting in a detrimental increase in the mean crystal size.

Bead mills have been used to create nanosized HE materials in the past; however, the material is trapped in an aqueous solution. An efficient method of filtering out the material, or coating it directly, without ripening the explosive, has, up to this point, not been found. See, Patel et al "Production and Coating of Nano-RDX Using Wet Milling," National Defense Industrial Association Insensitive Munitions and Energetic Materials (NDIA IM/EM) Symposium Proceedings, 2007.

Considering the above facts, there is a need in the art for a more insensitive HE material; with enhanced performance characteristics, especially in small critical diameter applications; that is, manufactured in an effective, safe, and relatively economical way.

SUMMARY OF INVENTION

The present invention relates to an effective, safe, and economical method of manufacturing insensitive high explosive (HE) crystalline molding powders; whereby, the resulting HE molding powder contain very small, i.e. nanosized, HE crystals, and said crystals are uniformly distributed within binder. Specifically, the subject method of manufacture involves: adding a water soluble binder and a crystalline high explosive material to water to form a mixture; agitating said mixture such that the water soluble binder generally dissolves and the crystalline high explosive is generally uniformly dispersed into suspension; and then bead milling that mixture to create the desired nano-sized explosive material crystal particles with a mean crystal size below 1000 nm in diameter, preferably below 500 nm. In a preferred alternative embodiment, crystalline explosive can first be mixed in water to provide a suspension, which is then bead milled to obtain the desired nano-sized HE crystal particles, and to that suspension the water soluble binder can be added and dissolved. Regardless, the resulting suspension of HE in a solution containing the dissolved binder ingredients is then spray dried to provide the desired HE molding powder, containing binder coated, nano-sized HE crystals.

The above disclosed spray drying operation can be readily accomplished using commercially available spray drying technology. Further, the recovered HE molding powder particles are from about 500 nanometers to about 20 microns; wherein, the mean HE crystal size is below 1000 nanometers, preferably below 500 nanometers; and wherein, the particles are surprisingly uniformly coated with binder. The composition of such novel molding powder granules can be readily controlled with the composition ranging from 50 to 99 weigh percent (wt. %) HE and the balance binder, and/or binder system containing any desired additives, such as a plasticizer or surfactant.

The high explosive molding powder formed by the present novel method overcomes the problems of the prior art by providing a HE molding powder which exhibits a significant reduction in both shock and impact sensitivity. Additionally, as also desired, the HE Molding powder also exhibits improved detonation characteristics such as a lowered critical diameter, enabling application of this insensitive material in explosive charges with small dimensions, such as boosters. Furthermore, this inventive method overcomes the problems of the prior art related to preparation of nanocrystalline HE based molding powders by consolidating the crystal formation and coating into a safe and economical process, which is free of any significant "ripening" effect.

The method described in the present invention is suitable for use with a variety of known and useful HE compounds, including RDX, HMX, CL-20, and others, or combinations thereof. Importantly, the binder must be water soluble, i.e. a non-energetic, inert polymer binder—such as polyethylene glycol (PEG), or more preferably, polyvinyl alcohol (PVOH). Use of an organic solvent, which will dissolve or ripen the nitramine crystalline HE, is not advisable—since either dissolving the crystalline HE or causing the crystalline HE to ripen results in undesired crystal size increase. However, a relatively small quantity of a fatty alcohol water based defoamer/dispersing agent, such as isobutanol, can be added to enhance manufacturability. Finally, the binder may be a binder system, containing water soluble plasticizers, surfactants and other minor ingredients as desired.

DETAILED DESCRIPTION

The present inventive method provides an effective, efficient, and inexpensive means of manufacturing insensitive high explosive molding powders formed of granules, containing from about 50 to 99 weight percent of a crystalline high explosive material. The balance of the weight percentage being a non-energetic binder; wherein the crystals within the high energy explosive material are nano-sized and uniformly coated with a non-energetic binder or non-energetic binder system, and wherein the final granules range from about 0.5 to about 20 microns in size. The subject inventive method of manufacture involves first creating a solution of a non-energetic binder, or a binder system, i.e. including any desired plasticizer or surfactant with the binder, in water, to form an aqueous solution and then adding a crystalline high explosive material (which crystalline HE material will be held in-suspension within the aqueous binder solution). Then bead milling the mixture until the crystalline explosive material is nano-sized, i.e. having a mean crystal size below 1000 nm in diameter. If desired, in addition to the binder/binder system, HE crystalline material, and water—an effective quantity of a defoamer/dispersant/surfactant can be added to the solution (prior to adding the crystalline high explosive thereto and prior to milling of the mixture thereof), preferably a alcohol dispersant, most preferably isobutanol or similar. In a preferred alternative embodiment, the process can be also performed by addition of the binder to the suspension post milling. The desired final binder/explosive molding powder is then recovered from the aqueous solution/suspension mixture by spray drying using commercially available spray drying technology. The relative amounts of the crystalline explosive and binder/binder system ingredients which are dissolved in the water to form the aqueous solution/suspension should be chosen to reflect the desired composition of the resulting molding powder, as the composition of the resulting molding powder granules will be nearly identical to the relative composition of such ingredients initially placed in solution. Preferably, the inventive formulation consists of 50 to 99 weight percent crystalline HE and the balance being the binder, or binder system, containing desired additive(s), such as a plasticizer and/or surfactant.

The required bead milling to form the nano-sized crystalline HE is done in a commercially available bead mill which accepts the aqueous solution of crystalline explosive material, with or without the binder/binder system in the aqueous solution, and provides the desired nano-sized explosive HE crystals. Particularly useful bead mills include the DMQX™ Horizontal Bead Milling System, available from Union Process Inc, of Akron; the MicroMedia™ Nano bead mill, from Bühler inc., Plymouth, Minn.; the Ultra-Apex Mill type UAM-015 manufactured by Kotobuki Ind. Co. Ltd., Joto-ku, Osaka, Japan; and preferably the Netzsch Bead Mill (Microseries) available from NETZSCH Premier Technologies, Inc., Exton, Pa.—among others.

In the present method, as is common in spray drying, the precipitation of the dissolved ingredients occurs and the formation of granules is achieved by atomizing the aqueous binder solution/HE explosive material suspension into droplets and drying such droplets in a flowing stream of heated gas—preferably air or nitrogen. Most commercially available spray dryers may readily be used in this invention. Depending on the desired grain size of the molding powder, several spraying approaches can be selected. The atomization of the feed solution may be achieved using a variety of standard atomizers including compressed gas, ultrasonic, and rotary disk. The droplet size distribution may be varied by manipulation of the solution feed rate, and by nozzle settings. For example, the commonly used gas atomized nozzle, the nozzle diameter and the atomizing gas flow rate may be adjusted to get the desired droplet size—to result in a particular granule size. In the case of the ultrasonic nozzle, the nozzle frequency and amplitude may be used as the control parameter.

In the subject inventive spray drying process, the precursor solution/suspension may be fed to the atomizer using a variety of available liquid pumps, however, for product uniformity, it is desired that the pumping be relatively steady, rather than pulsating. Preferred pump types include, but are not limited to: centrifugal, peristaltic, piston, and diaphragm type pumps.

Furthermore, in the subject spray drying process, the temperature of the drying chamber should be selected such that the solution droplets are completely or nearly completely dried within the drying chamber. The temperature should not exceed that at which decomposition of the product may occur—preferably less than 150 degrees Centigrade.

Finally, the molding powder granules obtained from the subject inventive spray drying process are separated and recovered from the gas stream using a cyclone separator, filtration, or other known means.

To aid in the understanding of the subject inventive method, the following examples are provided as illustrative of thereof—however, they are merely examples and should not be construed as limitations on the claims:

EXAMPLE 1

An explosive molding powder containing 95 wt. % HMX and 5 wt. % PVOH binder was prepared. The preparation of this molding powder began by mixing 6.7 wt. % FEM HMX (the smallest particle size HMX that is commercially available), 0.35 wt. % PVOH, and 2.3 wt. % isobutonal with 90.65 wt. % water—where the PVOH and isobutonal dissolved easily and the HMX remained in suspension. The mixture was milled using a Netzsch Agitator Bead Mill with 300 micron yttria stabilized zirconia beads, available from Netzsch Inc., Exton, Pa. The mill was set to a speed of 6,800 rpm and the mixture was milled for approximately 1 hour. The mean crystal size of the milled HMX as determined by dynamic light scattering was 300 nm. The suspension was then spray dried using a Büchi B290 spray dryer (Büchi Labortechnik AG, Switzerland), equipped with a two fluid nozzle gas atomization configuration. The inert drying gas ($N_2$) inlet temperature was set at 140 degrees Centigrade. The final, desired, insensitive molding powder product was collected using a cyclone separator.

The product granule size ranged from about 0.5 to about 10 microns. Optical and electronic microscopy revealed that the granules are primarily composed of nanocrystalline HMX with a homogeneous distribution of binder and HE. The composition of the product was also verified using HPLC analysis to match that of the original feed slurry.

EXAMPLE 2

Using the procedure outlined in Example 1, a molding powder consisting of 90% CL 20 and 10 wt. % polyvinyl alcohol was prepared and milled for 10 minutes, but otherwise subjected to the same process. The measured mean crystal size of CL-20 after milling was 400 nm. Optical and electron microscopy revealed that the granule size, the HE crystal size, and the uniformity of binder coating on the HE crystals was analogous to the sample described in Example 1—as desired.

Sensitivity Analysis

HMX samples, as prepared in Example 1 were subjected to impact sensitivity tests performed using an Explosive Research Laboratory (ERL), Type 12 impact tester, with a 2.5 kg drop weight. This method is described in MIL STD 1751A, Method 1012, "Impact Sensitivity Test-ERL (Explosives Research Laboratory)/Bruceton Apparatus," copies of which are available at http://assist.daps.dla.mil/ or from the Department of Defense, Standardized Document Order Desk, 700 Robbins Avenue, Bldg., 4D, Philadelphia, Pa. 19111-5094. The test is performed by dropping the drop weight from incremental heights and recording whether the HMX sample initiates, i.e. an explosion occurs. The drop height is repeated and adjusted in order to determine the height at which initiation probability is 50% (H50) and the impact sensitivity is given as the H50 value. The impact sensitivity of the HMX/PVOH formulation of Example 1 is >125.9 cm. This can be compared to a legacy booster material, LX 14, which has a similar amount of HMX, but a significantly worse impact sensitivity, i.e. only 26 cm.

Shock sensitivity analysis was performed with the NOL Small-Scale Gap Test according to MIL-STD-1751A, Method 1042, copies of which are available at http://assist.daps.dla.mil/ or from the Department of Defense, Standardized Document Order Desk, 700 Robbins Avenue, Bldg., 4D, Philadelphia, Pa. 19111-5094. Samples of C1-20 and HMX prior art HE molding powders and molding powders produced according to the present method were pressed to comparable percentages of theoretical maximum density (% TMD). The shock sensitivity test results are summarized in Table 1, proving the formulations made with the inventive bead milled/spray dried composition are significantly less sensitive. In fact, both the prior art FEM CL-20/PVOH explosive and prior art FEM HMX/PVOH explosive were found to be a third more shock sensitive than the milled (i.e. 400 nm) CL-20/PVOH and the milled (i.e. 300 nm) HMX produced by the current inventive method.

TABLE 1

| Shock Sensitivity | | | | | |
|---|---|---|---|---|---|
| Explosive | Binder | Wt. % Explosive | Density (g/cc) | Decibangs (DBg) | kBars |
| FEM CL-20 (prior art) | PVOH | 90 | 1.86 | 7.41 | 36.5 |
| milled CL-20 | PVOH | 90 | 1.86 | 8.72 | 55.5 |
| FEM HMX (prior art) | PVOH | 95 | 1.66 | 7.375 | 36.0 |
| milled HMX | PVOH | 95 | 1.60 | 8.5 | 51.7 |

Although the invention has been described in general terms and using specific examples, it is understood by those of ordinary skill in the art that variations and modifications can be effected to these general and specific embodiments, without departing from the scope and spirit of the invention.

We claim:

1. A method of manufacture of an insensitive high explosive molding powder comprising:

adding both a water soluble, non-energetic binder, and a crystalline high explosive into water to form a mixture;

agitating the mixture such that the water soluble, non-energetic binder is generally dissolved and the crystalline high explosive is generally, uniformly suspended in the mixture;

milling the mixture in a bead mill until the crystalline high explosive material is nano-sized, wherein the nano-sized particles has an average crystal size of less than 1 μm;

spray drying the mixture containing the nano-sized crystalline high explosive material to produce powder granules wherein the granules comprises nano-sized crystalline high explosive material uniformly coated with the non-energetic binder.

2. The method of manufacture of an insensitive high explosive molding powder according to claim 1, where in the crystalline high explosive is selected from the group consisting of RDX, HMX, CL-20, or combination thereof.

3. The method of manufacture of an insensitive high explosive molding powder according to claim 1, wherein the water soluble, non-energetic binder is an inert polymer.

4. The method of manufacture of an insensitive high explosive molding powder according to claim 1, wherein to the water soluble, non-energetic binder, crystalline high explosive and water mixture is added an effective quantity of a defoaming/dispersant/surfactant agent.

5. The method of manufacture of an insensitive high explosive molding powder according to claim 4, wherein the defoaming/dispersant/surfactant agent is isobutanol.

6. The method of manufacture of an insensitive high explosive molding powder according to claim 5, wherein the water soluble, non-energetic binder, crystalline high explosive and water mixture is formed of 0.35 wt. % binder, 6.7 wt. % crystalline HE material, 2.3 wt. % isobutanol and 90.65 wt. % water.

7. The method of manufacture of an insensitive high explosive molding powder according to claim 1, wherein the binder includes a plasticizer or surfactant.

8. The method of manufacture of an insensitive high explosive molding powder according to claim 1, wherein the milled crystalline high explosive material is below 500 nm in average particle diameter.

* * * * *